United States Patent [19]

McEntee et al.

[11] Patent Number: 4,643,920

[45] Date of Patent: Feb. 17, 1987

[54] METHOD FOR INCORPORATING ANTIMICROBIALS INTO FIBERS

[75] Inventors: Thomas C. McEntee; Lawrence J. Guilbault, both of Topsfield; James F. Brophy, N. Reading; Judith L. Koob, Danvers, all of Mass.

[73] Assignee: Morton Thiokol Inc., Chicago, Ill.

[21] Appl. No.: 836,911

[22] Filed: Mar. 6, 1986

Related U.S. Application Data

[62] Division of Ser. No. 657,117, Oct. 3, 1984, abandoned.

[51] Int. Cl.[4] ..... B32B 27/00; D02G 3/00

[52] U.S. Cl. ..... 427/434.6; 8/490; 428/375; 428/379; 428/395; 428/396; 428/907

[58] Field of Search ..... 428/375, 379, 395, 396, 428/907; 8/490; 427/434.6

[56] References Cited

U.S. PATENT DOCUMENTS

| | | | |
|---|---|---|---|
| Re. 21,197 | 9/1939 | Hill et al. | 300/21 |
| 3,197,430 | 7/1965 | Lowes | 260/45.95 |
| 3,198,764 | 8/1965 | Lowes | 260/43.95 |
| 3,198,765 | 8/1965 | Lowes | 260/45.95 |
| 3,282,878 | 11/1966 | Lowes | 260/29.6 |
| 3,284,395 | 11/1966 | Lowes | 260/29.6 |
| 3,959,556 | 5/1976 | Morrison | 428/364 |

*Primary Examiner*—Marion C. McCamish
*Attorney, Agent, or Firm*—Gerald K. White

[57] ABSTRACT

A lower temperature technique for incorporating antimicrobial agents into fibers following the melt step in fiber manufacturing processes results in several advantages when contrasted with incorporation during the molten state.

23 Claims, 3 Drawing Figures

METHOD FOR INCORPORATING ANTIMICROBIALS INTO FIBERS

This is a divisional of co-pending application Ser. No. 657,117 filed on Oct. 3, 1984, now abandoned.

CROSS REFERENCE TO OTHER APPLICATIONS

This application is related in subject matter to four other applications that were filed concurrently with this application and were commonly assigned. They are: Application Ser. No. 657,119, invented by Lawrence J. Guilbault, Thomas C. McEntee, and Judith L. Koob and entitled "METHOD FOR CONTROLLING ANTIMICROBIAL CONTENT OF FIBERS", Application Ser. No. 657,118, now U.S. Pat. No. 4,592,843 invented by Lawrence J. Guilbault and Thomas C. McEntee and entitled "METHOD OF REMOVING A TOXICANT FROM WASTEWATER"; Application Ser. No. 657,116, now U.S. Pat. No.4,601,831 invented by Michael M. Cook and entitled "ANTIMICROBIAL ADJUSTMENT TECHNIQUE"; and Application Ser. No. 657,278, now abandoned, invented by Thomas C. McEntee, Lawrence J. Guilbault, Judith L. Koob and James F. Brophy and entitled "METHOD FOR INCORPORATING ANTIMICROBIALS INTO FIBERS".

BACKGROUND OF THE INVENTION

This invention generally pertains to a technique for incorporating antimicrobial agents into fibers following the melt spinning step in fiber manufacturing processes. The process of the invention results in a fiber having an essentially homogeneous distribution of the agent throughout the fiber cross-section. This invention is contrasted with prior art activities which have either focused upon surface treatment with antimicrobial agents or upon melt incorporation to achieve essentially uniform distribution throughout the fiber cross-section. Surface treatment techniques are illustrated by U.S. Pat. No. 4,408,996.

Antimicrobial agents, such as 10,10'-oxybisphenoxarsine, (OBPA), are known to serve to provide protection against bacterial attack of thermoplastic fiber materials, such as Nylon 6. The incorporation of OBPA also serves to reduce the occurrence of mildew and other undesirable growth on the fiber when in final product form such as carpeting. OBPA has been incorporated into molten nylon so as to be included in as-spun fiber. This results in an essentially homogeneous distribution of the agent through the fiber cross-section. U.S. Pat. No. 3,345,341 is illustrative of such prior techniques.

However, melt incorporation is unsatisfactory for many antimicrobial agents such as bis(tri-n-butyl tin)oxide (TBTO), because the temperatures of the molten fiber material are sufficiently high to destroy the effectiveness of the agent. Hence, a lower temperature incorporation alternative technique provides considerable attractiveness to the fiber industry.

In addition, it is not uncommon in the industry to encounter losses of antimicrobial agent during the dyeing operations which range up to about 70%. These losses are believed to be caused by leaching of the antimicrobial agent resulting in an equilibrium proportioning of the agent between the solid phase (fiber) and the liquid phase (dye bath medium).

In the past, this problem has been avoided by solution dyeing in which the dye is incorporated into the melt along with the antimicrobial agent at the melt-spinning state. For example, nylon carpet containing melt incorporated OBPA is currently manufactured in this manner. However, solution dyed carpeting is only available in a rather limited number of shades and, of course, can only be dyed by the fiber manufacturer. It would be desirable for the carpet manufacturers to be able to process undyed bulk fiber into carpeting by incorporating an antimicrobial agent homogeneously throughout the carpet fiber during or subsequent to the dyeing process. This procedure would provide greater latitude as to color selection and would provide greater flexibility for the overall manufacturing process. It is believed that the process of this invention overcomes the above mentioned problems in a highly advantageous and efficient manner by adding or exhausting the antimicrobial agent into the fiber only in the amount ultimately required during the dyeing step.

SUMMARY OF THE INVENTION

The invention involves a method of incorporating an antimicrobial agent into a fiber which includes treating a fiber which does not include the agent by passing such fiber into a liquid containing a sufficient concentration of the agent to cause the agent to be exhausted into the fiber. The resultant product is characterized by having an essentially homogeneous distribution of the agent throughout the fiber cross-section. The product exhibits increased durability in this form. The product contains appreciable quantities of the antimicrobial agent in a form which has not been deteriorated by the heat of the temperatures encountered during melt spinning. Such deteriorated agent is usually in an oxidized form.

The product of the invention comprises a fiber containing an effective amount of an antimicrobial agent to provide protection against microbial attack of said fiber. The antimicrobial agent is present in an essentially homogeneous cross-sectional distribution throughout said fiber and is further characterized by the presence of a greater amount of active antimicrobial agent than if an equal total amount of the agent had been incorporated into the fiber when the fiber was in the molten condition. This is because potential losses by volatilization and/or degradation from exposure to the vigorous melt-spinning conditions are avoided. A particularly advantageous form of the product may include an antimicrobial agent that is unstable or volatile at the melting point of said fiber. Such agents include bis(tri-n-butyl tin)oxide (TBTO).

DETAILED DESCRIPTION OF THE INVENTION

Figure 2:
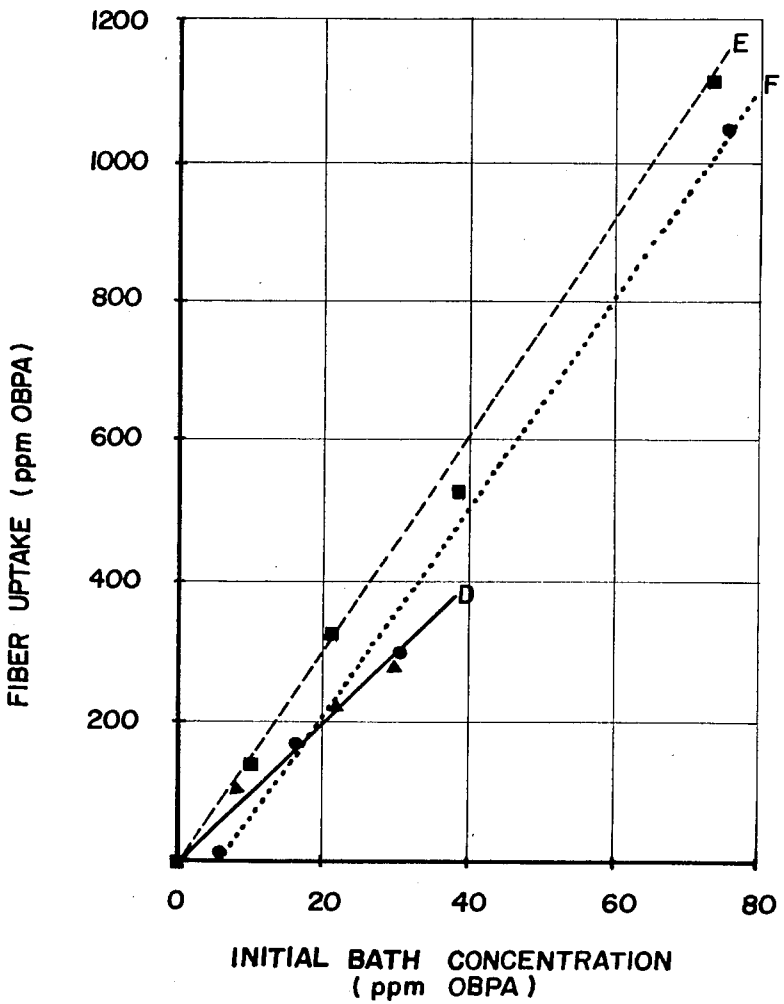
FIGS. 1, and 2 are plots of the OBPA uptake of Nylon 6 fibers vs. initial bath concentration.

The concentration of antimicrobial agents in fibers can be easily controlled during the practice of the invention. Basically, the process involves treating a fiber by passing the fiber through an antimicrobial agent containing medium. The concentration of the agent in the medium will constitute the major control variable to achieve the result of the process. However, it is also pointed out that time of passage and temperature of the fiber and medium are variables to consider when practicing the process of the invention. These variables are of a nature, however, that one skilled in the art could readily develop suitable parameters for various combinations of fiber, medium, and antimicrobial agent.

In the case of incorporating OBPA and TBTO with Nylon fiber, these hydrophobic, water-insoluble biocides approach an equilibrium apportionment between the fiber (solid phase) and the bath medium (liquid phase) which strongly favors the fiber phase. This method distributes the biocide throughout the fiber, avoiding the disadvantages of a surface application. The antimicrobial agent is compatible with the fiber and does not spew to its surface. The method also avoids the adverse processing conditions encountered when biocides are incorporated at the melt spinning step, thereby minimizing the possible formation of appreciable quantities of deteriorated antimicrobial agents or losses due to volatilization.

Conventional equipment utilized in dyeing of fibers provides a convenient vessel to hold the medium used for treatment of the fibers. For example, vats, stock dyeing, skein dyeing, rope dyers, continuous dye ranges, Kuesters or Becks would be suitable.

Fibers suitable for use in connection with the invention include synthetic, semisynthetic, or natural fibers or blends thereof. It is expected that this exhaustive method of biocide incorporation would also be useful with other biocides with similar hydrophobic/solubility properties and in treating other fiber compositions such as acrylics and polyesters. Synthetic fibers include but are not limited to polyamides such as Nylon 6 and Nylon 66, polyesters, polyacrylics, and modified cellulosics.

Suitable media for passage of the fiber include those which are capable of dissolving or dispersing the antimicrobial agent. Obviously the selection of such medium is dependent on the nature of the agent. Such property would be readily determined by one skilled in the art. It is preferred that the medium be a liquid. Normally an aqueous solution of the antimicrobial agent constitutes the preferred medium for reasons of economy and availability. Beck dye baths constitute a typical aqueous medium. Such dye baths typically comprise a continuous aqueous phase, surfactant, dye and pH adjusting agent. Other conventional dye baths such as continuous foam, kuester, dispersed, jet, etc. are also suitable.

The resultant product of the invention exhibits an essentially uniform distribution of antimicrobial agent across the cross-section of the fiber, ie; a substantially homogeneous distribution. This product and its cross-sectional antimicrobial distribution differs essentially from surface treated fibers as taught in U.S. Pat. No. 3,966,659. In addition, the inventive product contains a significantly higher proportion of active antimicrobial agent than a product having a uniform antimicrobial distribution that has been made by the prior art technique of belt incorporation.

The antimicrobial agent is preferably dissolved in an aqueous bath. Antimicrobials which do not readily form aqueous solutions are still suitable when a surfactant is used to assist in forming a bath to contact the fiber. The concentration of antimicrobial agent in the bath is a function of the concentration of the antimicrobial agent required in the finished textile. Generally the bath contains from about 0.001% to 1% antimicrobial.

Specific antimicrobial agents that may be employed include but are not limited to those described below.

Examples of the types of microbiocidal compounds which may be employed in this invention include, but are not limited to, phenoxarsines (including bisphenoxarsines), phenarsazines (including bisphenarsazines), maleimides, isoindole dicarboximides, having a sulfur atom bonded to the nitrogen atom of the dicarboximide group, halogenated aryl alkanols and isothiazolinone compounds. Organotin compounds are also specifically contemplated.

The microbiocidal phenoxarsine and phenarsazine compounds useful in the compositions of this invention include compounds represented by the formulas:

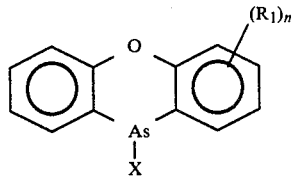

and

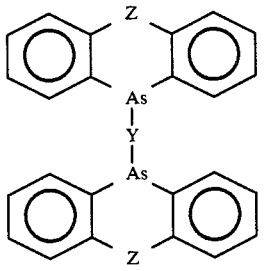

Where x is halogen or thiocyanate, y is oxygen or sulfur, z is oxygen or nitrogen, R is halo or lower alkyl, and n is 1 to 8.

Examples of these phenoxarsines and phenarsazines include, but are not limited to, 10-chlorophenoxarsine; 10-iodophenoxarsine; 10-bromophenoxarsine; 4-methyl-10-chlorophenoxarsine; 2-tert-butyl-10-chlorophenoxarsine; 2-methyl-8,10-dichlorophenoxarsine; 1,3,10-trichlorophenoxarsine; 2,6,10-trichlorophenoxarsine; 1,2,4,10-thiocyanato phenoxarsine; and 10,10'-thiobisphenoxarsine; 10,10'-oxybisphenarazine 10,10'-thiobisphenarsazine; and 10,10'-oxybisphenoxarsine (OBPA).

The microbiocidal maleimide compounds useful in the compositions of this invention are exemplified by a preferred maleimide, N-(2-methylnaphthyl)maleimide.

The microbiocidal compounds useful in the practice of this invention which are isoindole dicarboximides having a sulfur atom bonded to the nitrogen atom of the dicarboximide group are compounds which contain at least one group having the structure:

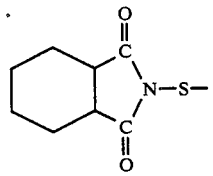

The preferred isoindole discarboximides are the following:

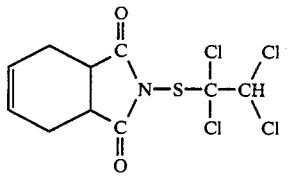

bis-N-[(1,1,2,2-tetrachloroethyl)thio]-4-cyclohexene-1,2-dicarboximide

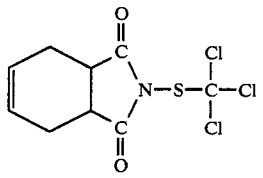

n-trichloromethylthio-4-cyclohexene-1,2-dicarboximide

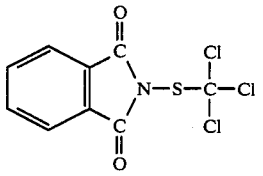

N-trichloromethylthio phthalimide

The halogenated aryl alkanols which can be used as microbiocidal compounds in accordance with this invention are exemplified by a preferred compound, 2,4-dichlorobenzyl alcohol.

An example of a preferred isothiazolinone compound useful in the composition of this invention is 2-(n-octyl-4-isothiazolin-3-one).

The most preferred microbiocidal compounds are the bisphenoxarsines and bisphenarsazines having the formula:

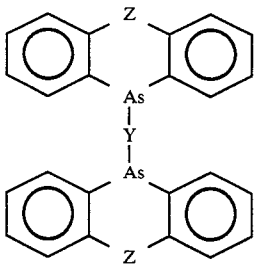

where Y is oxygen or sulfur and Z is oxygen or nitrogen. Of these bisphenoxarsines and bisphenarsazines, the most preferred are 10,10'-oxybisphenoxarsine; 10,10'-thiobisphenoxarsine; 10,10'-oxybisphenarsazine; and 10,10'-thiobisphenarsazine.

It is also within the scope of the invention to include other typical known antimicrobial agents such as bis(tri-n-butyl tin)oxide (TBTO) and the like.

It is contemplated that the invention may be practiced upon fibers at any stage of fabrication including but not limited to mono-filiments, bulked continuous filiment, staple, skein yarn, stack yarn, woven goods, greige goods, nonwoven scrim, needle-punched goods, knits, etc.

The practice of this invention includes but is not limited to the typical parameters set forth below. The range of bath volumes (mL) to fiber weight (g) ratios of 100:1 to 1:1 with a preferred ratios from 30:1 to 10:1. The latter range is preferred because the ratios are commonly used in commercial dye operations. The range of bath concentration levels includes 1 ppm to 120 ppm; with a preferred range from 15 ppm to 40 ppm. The 15 to 40 ppm range is preferred because the treated fiber will contain OBPA in the preferred range. The range of OBPA concentration in the fiber includes 10 to 3300 ppm; with a preferred range from 250–500 ppm. The latter range is preferred because this level provides good antimicrobial protection. The treatment time ranges from less than one minute to greater than 60 minutes; with a preferred range from 5 minutes to 30 minutes and the treatment temperature ranges from 20° C. to 100° C.; with a preferred range of 40° to 100° C. These respective preferred ranges were selected because they allow effective treatment within moderate handling time at temperatures efficient for OBPA uptake and commonly used for commercial dyeing. pH ranges from 4 to 7 and appears to have little or no effect upon the partitioning of the OBPA. This behavior suggests the non-interference of OBPA with terminal amino groups which are common sites for dye attachment in nylon fiber.

GENERAL PREPARATION OF FIBERS AND TREATMENT BATHS

Dye Bath

A simulated beck dye bath was prepared by adding 1 mL TRITON X-100 surfactant to 1 L tap water with stirring. The pH was adjusted to pH 4.0 or 7.0 with glacial acetic acid or ammonium hydroxide. Powdered OBPA (20–80 mg.) for the desired concentration was added with heating and stirring for one hour. The hot simulated dye bath was filtered through Whatman 2V paper and brought to the desired temperature. Dilutions of this dye bath were made as desired.

Sample Preparation 0.5 g samples of dyed, texturized, nylon 6 carpet yarn were wound around a small tared test tube, weighed, and slipped off as coils into 15×50 mm test tubes. The capped test tubes containing the yarn were preheated to the desired treatment temperature.

Treatment 10 mL aliquots of treatment bath were added to each test tube at recorded times. The samples were completely immersed in dye bath. Additional aliquots of initial dye bath (1–5 mL) were taken at the starting time for each sample for arsenic analysis. In the uniform concentration-varied time series, initial bath samplings were taken at three intervals.

The capped tubes were kept in constant temperature water baths without agitation at 40° C. or 90° C. and at ambient temperature for 25° C. For the Sorption Isotherm series, the final dye bath aliquots were removed for analysis at 30 minutes. For the OBPA-uptake vs. time series, aliquots were removed at timed intervals of 0.5, 1.0, 2.0, 3.0, 5.0, 10, 15, 30 and 60 minutes. Only one aliquot (1–5 mL) were removed from each tube. Immediately after the bath sampling, the yarn coil was removed with forceps and drained for 10 seconds. The fiber coils were rinsed in fresh 50 mL portions of deionized water for 15 seconds, finger squeezed, and air-dried overnight at 45° C. All samples containing OBPA indicated antimicrobial activity.

Isopropanol washes of these bath-treated fibers contained no detectable arsenic indicating that the OBPA was incorporated throughout the fiber rather than distributed on the surface. Isopropanol does not swell nylon, but does dissolve OBPA.

The treatment bath samples were acid digested and analyzed for total arsenic by the SDDC method. The arsenic depletion in the treatment baths was used to calculate the approximate fiber (yarn) concentration, as OBPA. Some fiber samples were analyzed directly by the SDDC method.

EXAMPLE I

Nylon 6 fibers were treated in an OBPA-containing surfactant bath for 30 minutes in the above described general manner. A bath ratio (bath volume, mL: fiber weight, (g) of 20:1 was used. A pH of 4 was used. Other variables are listed below in Table 1.

TABLE 1

| Trial No. | Temp. (°C.) | Initial Bath OBPA-CONC. (ppm) |
|---|---|---|
| A | 25 | 0–29 |
| B | 40 | 0–32 |
| C | 90 | 0–27 |

Figure 1:
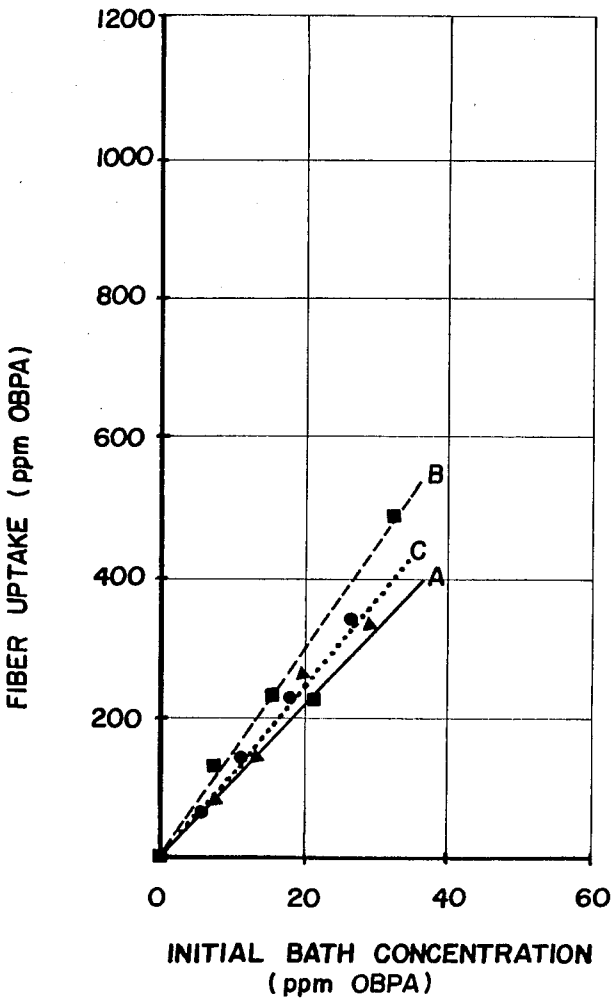

The results of Trials A–C are shown in FIG. 1.

EXAMPLE II

The trials of Example I were repeated with a pH of 7. The only other variables that were different are listed below in Table 2.

TABLE 2

| Trial No. | Temp. (°C.) | Initial Bath OBPA CONC. (ppm) |
|---|---|---|
| D | 25 | 0–31 |
| E | 40 | 0–72 |
| F | 90 | 0–75 |

The results of trials D–F are shown in FIG. 2.

EXAMPLE III

The trials of Example I were repeated. The only other variables that were different are listed below in Table 3.

TABLE 3

| Trial No. | Fiber-Nylon 6 | Bath Conc. OBPA (ppm) | Temp. (°C.) | Treatment Time (Min.) |
|---|---|---|---|---|
| G | Dyed, textured yarn | 29 | 40 | 0.5–60 |
| H | Dyed, textured yarn | 22 | 90 | 0.5–60 |
| I | Undyed, non-textured yarn | 30 | 40 | 0.75–30 |

Figure 3:
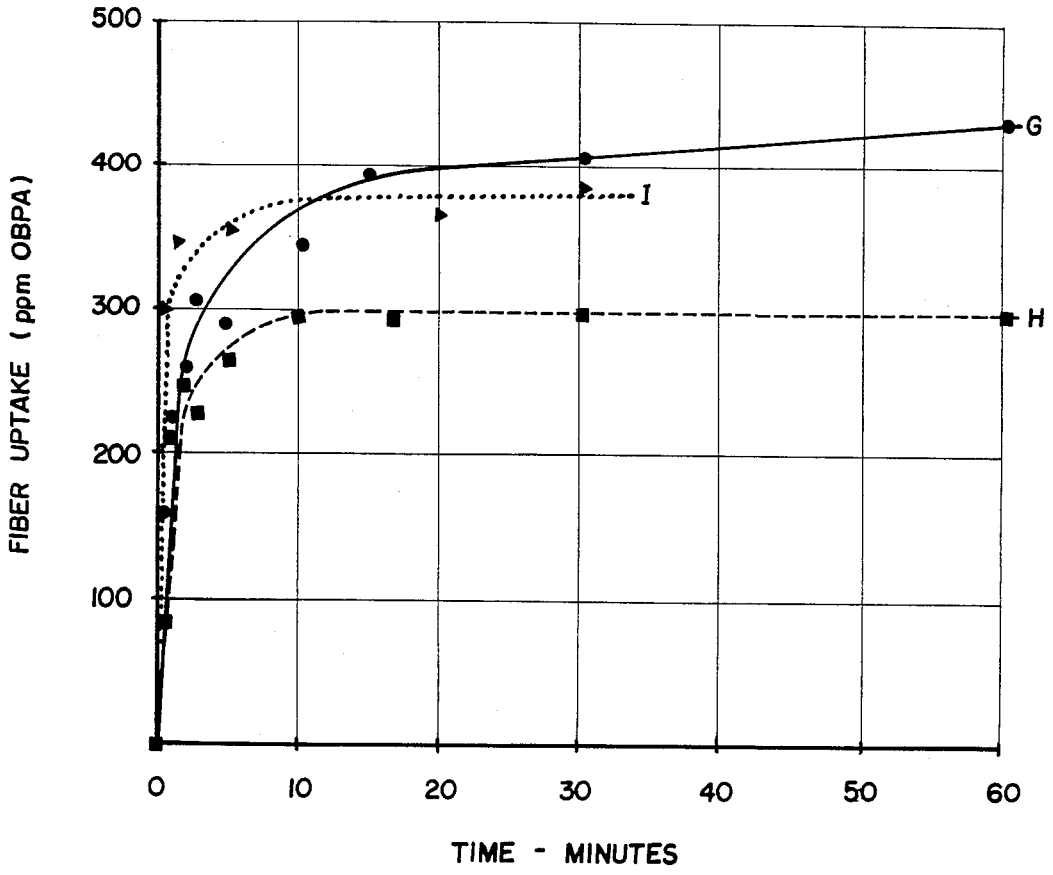
FIG. 3 is a plot of OBPA uptake of Nylon 6 fibers vs. time.

The results of trials G–I are shown in FIG. 3.

EXAMPLE IV

Bis(tri-n-butyl tin)oxide 30.2 mg of 98% (TBTO) was added to 500 mL tap water containing 0.5 mL TRITON X-100. The bath concentration was about 50–60 ppm TBTO. The bath was stirred and heated to boiling. Nylon yarn was loosely tied into 4 1.0-g hanks.

Two hanks of yarn were immersed and agitated in 20 and 100-parts by volume, respectively, of boiling treatment bath, maintained at 90°–95° C. for 30 minutes. The samples were rinsed in deionized water and dried at 45° C. overnight. The results are shown below in Table 4.

TABLE 4

| Sample # | Fiber Weight, g | Bath vol.: Fiber wt. mL:g | Fiber Analysis ppm Sn Calc. as TBTO | Staphylococcus Zone of Inhibition, mm |
|---|---|---|---|---|
| 1 | 1.0 | 20:1 | 639 | 7 |
| 2 | 1.0 | 100:1 | 2534 | 11 |

We claim:

1. A method for incorporating an antimicrobial agent into a fiber, comprising:

treating a fiber which does not contain an antimicrobial agent by passing said fiber into a liquid medium containing a solution of an antimicrobial agent in a concentration sufficient to cause an effective amount of said agent to be exhausted into the fiber and to be incorporated in an essentially homogeneously cross-sectional distribution throughout said fiber; said effective amount being sufficient to provide protection against microbial attack of said fiber.

2. The method of claim 1, wherein:

said fiber is a member selected from the group consisting of synthetic fibers, semisynthetic fibers, natural fibers, and blends thereof.

3. The method of claim 2, wherein:

said fiber is nylon.

4. The method of claim 3, wherein:

said antimicrobial agent is 10,10′-oxybisphenoxarsine.

5. The method of claim 4, wherein:

a bath volume of fiber weight ratio from about 100:1 to 1:1 is utilized during the process.

6. The method of claim 5, wherein:

said ratio is from about 30:1 to 10:1.

7. The method of claim 4, wherein:

said concentration of 10,10′-oxybisphenoxarsine in said medium is from about 1 ppm to 120 ppm.

8. The method of claim 7, wherein:

said 10,10′-oxybisphenoxarsine concentration in said medium is from about 15 ppm to 40 ppm.

9. The method of claim 4, wherein:

from about 10 ppm to 3300 ppm of 10,10′-oxybisphenoxarsine is exhausted into said nylon fiber.

10. The method of claim 9, wherein:

from about 250 pm to 500 ppm of 10,10′-oxybisphenoxarsine is exhausted into said nylon fiber.

11. The method of claim 1, wherein:

said antimicrobial agent is a member selected from the group consisting of 10,10′-oxybisphenoxarsine and bis(tri-n-butyl tin)oxide.

12. The method of claim 11, wherein:

said antimicrobial agent is 10,10′-oxybisphenoxarsine.

13. The method of claim 1, wherein:

said antimicrobial agent is 10,10′-oxybisphenoxarsine, said fiber is nylon and the concentration of said agent is said liquid medium is from about 0.001% to 1%.

14. The method of claim 1, wherein:

said medium comprises an aqueous dyeing medium which also serves as to dye said fiber during passage of said fiber through the medium.

15. The method of claim 14, wherein:

said medium is a beck dye bath.

16. The method of claim 1, wherein:

said antimicrobial agent is a member of the group consisting of phenoxarsines, phenarsazines, maleimides, isoindole dicarboximides having a sulfur atom bonded to the nitrogen atom of the dicarboximide group, halogenated aryl alkanols, isothazolinones, and organotin compounds.

17. The method of claim 1, wherein:

said antimicrobial agent is n-(2-methylnaphthyl)-maleimide.

18. The method of claim 1, wherein:

said antimicrobial agent is bis-n-[(1,1,2,2-tetrachloroethyl)]-4-cyclohexene-1,2-dicarboximide.

19. The method of claim 1, wherein:

said antimicrobial agent is n-trichloromethylthio-4-cyclohexene-1,2-dicarboximide.

20. The method of claim 1, wherein:

said antimicrobial agent is n-trichloromethylthio phthalimide.

21. The method of claim 1, wherein:

said antimicrobial agent is 2,4-dichlorobenzyl alcohol.

22. The method of claim 1, wherein:

said antimicrobial agent is 2-(n-octyl-4-isothiazolin-3-one.

23. The method of claim 1, wherein:

said antimicrobial agent is bis(tri-n-butyltin)oxide.

* * * * *